United States Patent [19]

Bussey, Jr.

[11] 4,169,179

[45] Sep. 25, 1979

[54] SPRING-LIKE LOOSE FILL PACKAGING MATERIAL

[76] Inventor: Harry Bussey, Jr., P.O. Box 115, Serpentine Dr., Navesink, N.J. 07752

[21] Appl. No.: 840,295

[22] Filed: Oct. 7, 1977

[51] Int. Cl.[2] ..... B32B 3/30

[52] U.S. Cl. ..... 428/159; 206/523; 206/584; 206/814; 428/167; 428/179; 428/402; 428/542

[58] Field of Search ..... 428/155, 159, 160, 167, 428/332, 358, 402, 542, 179; 206/54, 523, 584; 264/5; 260/2.5 E; 261/DIG. 72; 93/1 WZ

[56] References Cited

U.S. PATENT DOCUMENTS

| | | | |
|---|---|---|---|
| 2,860,768 | 11/1958 | Smithers | 206/523 |
| 3,181,766 | 5/1965 | Kane et al. | 206/523 |
| 3,384,221 | 5/1968 | Houtman | 206/523 |
| 3,896,934 | 7/1975 | Graham et al. | 206/523 |
| 3,961,006 | 6/1976 | Ropiequet | 428/402 |
| 4,027,064 | 5/1977 | Bussey, Jr. | 206/523 |
| 4,042,658 | 8/1977 | Collins | 428/402 |

FOREIGN PATENT DOCUMENTS 1369349 3/1963 France .

*Primary Examiner*—Stanley S. Silverman
*Attorney, Agent, or Firm*—Kenyon & Kenyon

[57] ABSTRACT

The loose fill packaging material of the illustrated embodiment comprises a plurality of elements of, for example, expanded polystyrene. Each packaging element of the embodiment is of a generally block-like form which includes a body portion of a spring-like construction and two leg portions. The spring-like construction is formed by slitting a surface of the body portion at spaced-apart locations prior to the complete expansion of the packaging element.

12 Claims, 10 Drawing Figures

Fig. 1.
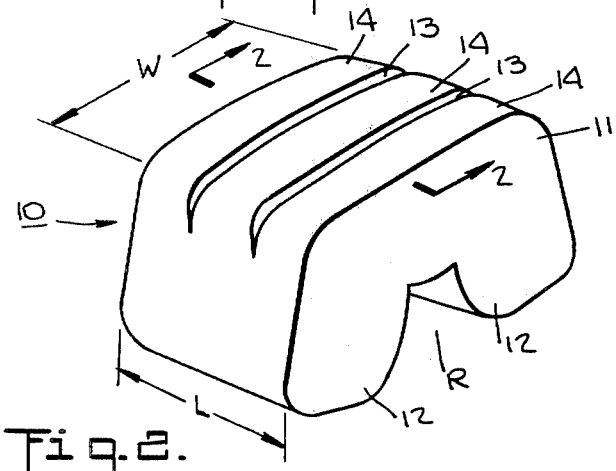
Fig. 6.
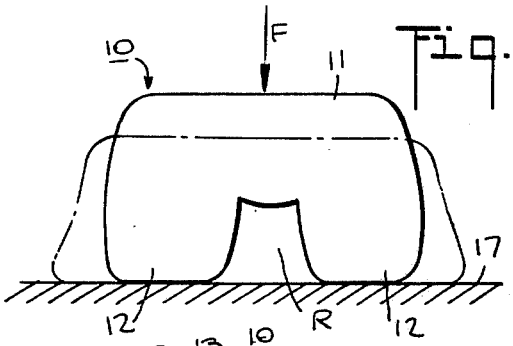
Fig. 2.
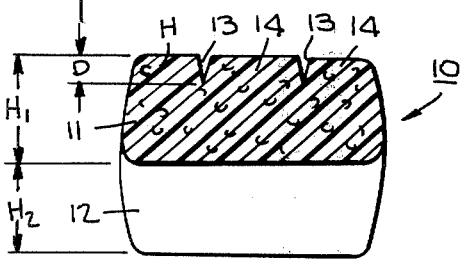
Fig. 5.
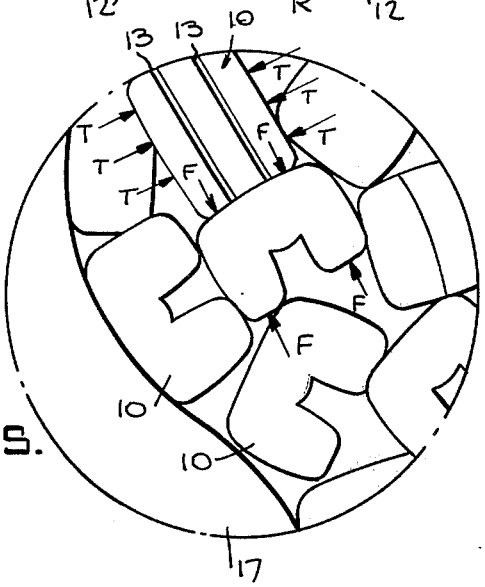
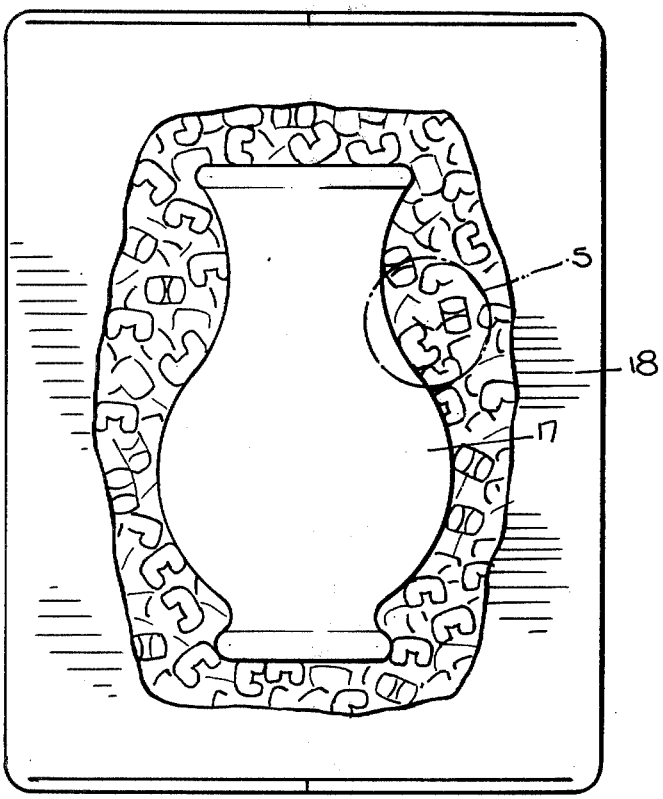
Fig. 4.
Fig. 3.
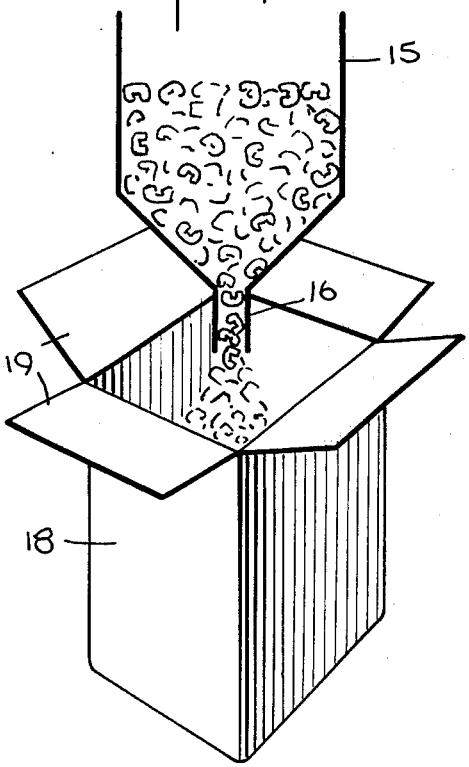

EXTRUSION
SLITTING
COOLING
CUTTING
HEATING

SPRING-LIKE LOOSE FILL PACKAGING MATERIAL

This invention relates to a packaging material and, more particularly, to a loose fill packaging material comprised of elements of a spring-like construction.

Various types of loose fill packaging materials have heretofore been known. For example, U.S. Pat. No. 4,027,064 describes materials made of expandable or expanded thermoplastic material and formed with various shapes. Also, U.S. Pat. No. 3,074,543 describes elements made in the form of small collapsible cylinders; U.S. Pat. No. 3,188,264 describes elements with an elongated H-shape or Y-shape cross-section; and U.S. Pat. No. 3,251,728 describes elements with various random shapes.

Loose fill packaging materials are generally intended to provide a cushion to protect an item being transported in a shipping container against severe impacts or strong vibrations. A loose fill protective cushion has heretofore been provided by inserting a mass of thermoplastic packaging elements, for example made of expanded or foamed polystyrene, into the shipping container and about the item being packaged. With such prior loose fill packaging material, impact or vibration forces imposed on the shipping container have been absorbed by the inherent resiliency of the foamed material of which the packaging elements are made, or by the interrelationship of the various packaging elements one to another in the mass of elements about the item being packaged in the shipping container. Also, loose fill packaging elements are known, for example elements in the form of hollow cylinders, whose configuration may tend to provide resilience or an ability to absorb impact loads or vibrational forces and deter the transmittal of such loads and forces to the item being packaged.

The capacity of a given form of loose-fill packaging material to deter the transmittal to the item being packaged of loads and forces imposed upon its shipping carton or container, as well as the cost of the quantity of a given form of loose fill packaging material required for a desired amount of cushioning, and the weight and volume of such a quantity of packaging materials, are all factors which are generally considered with respect to loose fill packaging materials. For example, any increase in the volume or weight of packaging material required for a given application tends to increase the cost of shipment of the packaged item to be transported.

Accordingly, it is an object of the invention to provide a loose fill packaging material which provides an improved cushioning effect for packaging an item within a shipping carton.

It is another object of the invention to provide a loose fill packaging material of relatively simple construction which has spring-like characteristics and can be manufactured in a relatively simple manner.

It is another object of the invention to provide a loose fill thermoplastic packaging material which has an improved capacity for absorbing the energy of impact upon a shipping container containing an item packed therein.

Briefly, the invention provides a loose fill packaging material which is comprised of a plurality of resilient elements, each of which has a body portion and at least two leg portions extending from the body portion, and in which the body portion is provided with a plurality of grooves at predetermined locations in a surface opposite the leg portions. The grooves define a plurality of interconnected body portion segments which are disposed perpendicularly of the leg portions. These interconnected segments allow each element to act in the manner of a series of interconnected flat springs. That is, the individual segments of an element can be moved towards one another to absorb a load prior to any substantial compression of the material of which the packaging element is made.

In a described embodiment, the grooves in each packaging element extend transversely of the axis of each of the leg portions of the element. Thus, the leg portions can provide resiliency relative to forces which are imposed in one direction on the elements, while the defined segments of the body portion provide a capacity to absorb loads in a perpendicular direction.

In a described embodiment, the resilient elements are formed in a block-like U-shape with two leg portions which extend outwardly from a body portion. Alternatively, the packaging elements may be of a block-like E-shape so as to have three legs extending from the body portion and grooves in the surface of the body portion opposite the leg portions.

In order to make the resilient elements, an extrudable mass of thermoplastic material having an expanding agent therein is extruded through a die having an appropriately shaped outlet. At the same time, a fly knife forms a series of slits in the extrudate on a side opposite from the leg portions of the extrudate. Subsequently, the extrudate is processed in a known manner and is cut into individual pieces by a suitable cutting means to form the individual discrete packaging elements. During expansion of the extrudate or of the discrete elements, the slits form grooves in the surface of the body portion of the individual segments. The spacing of the slits is such that each element has a plurality of slits or grooves therein at predetermined locations.

The packaging material can be made of any suitable resilient material. For example, the packaging material can be made of a resilient thermoplastic material selected from the group consisting of polystyrene, polyethylene, polypropylene and polyurethane. Further, when made of a thermoplastic material, the packaging material can be supplied in an expandable state or in an expanded state. In the former case, the user may expand the packaging element to an expanded state when the elements are to be used.

These and other objects and advantages of the invention will become more apparent from the following detailed description and appended claims taken in conjunction with the accompanying drawings in which:

FIG. 1 illustrates a perspective view of a packaging element according to the invention;

FIG. 2 illustrates a view taken on line 2—2 of FIG. 1;

FIG. 3 illustrates a cross-sectional view of a supply hopper discharging packaging material of the invention into a shipping carton;

FIG. 4 illustrates a partly sectional view of a shipping carton containing a vase packed with packaging material of the invention;

FIG. 5 illustrates an exploded detail view taken within circle 5 of FIG. 4;

FIG. 6 illustrates a schematic view of a manner in which a packaging element of the invention resists a compressive force:

Figures 7, 8, 9, 10:
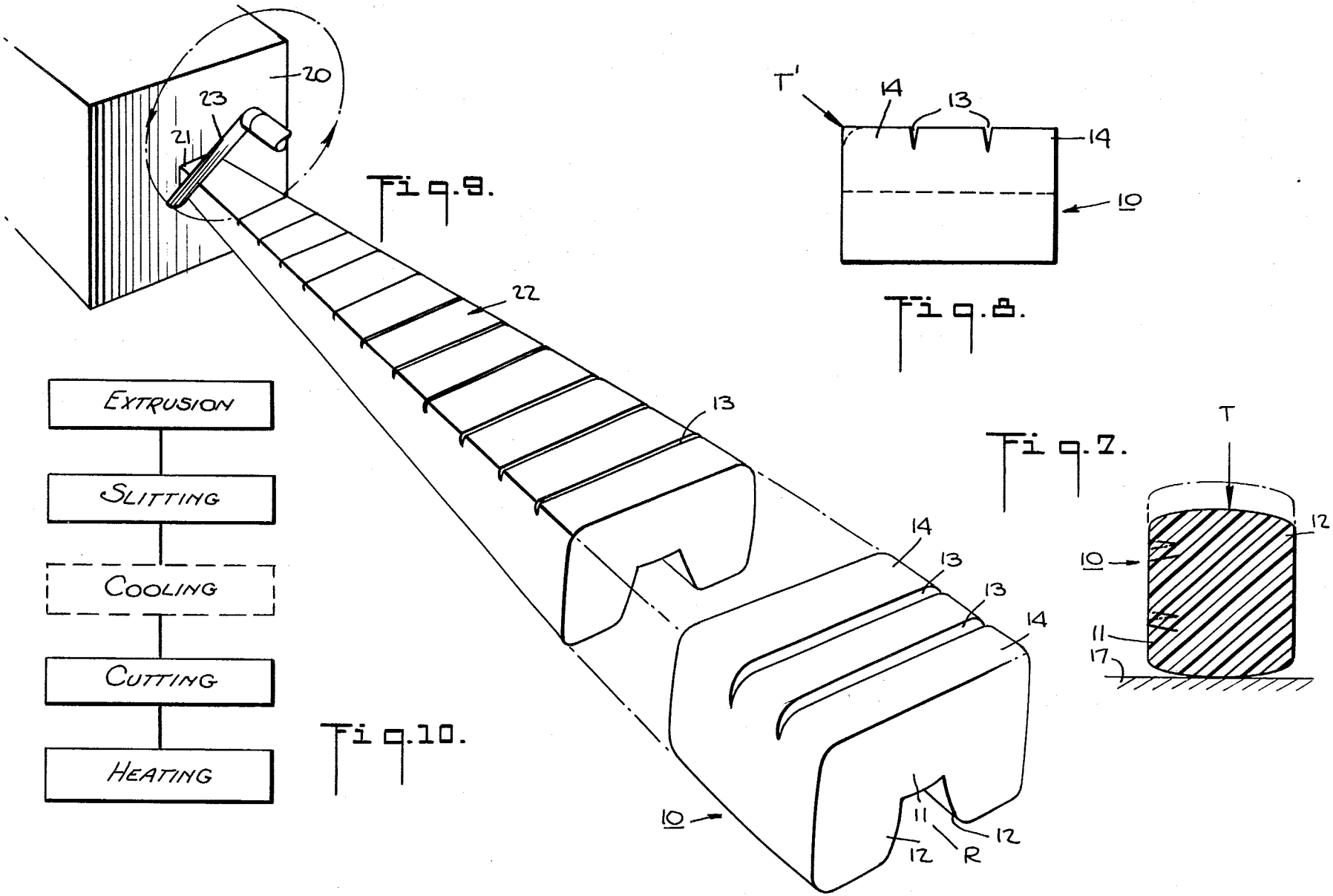
FIG. 7 illustrates a schematic view of a further manner in which a packaging element of the invention resists a compressive force.
FIG. 8 illustrates a schematic view of a further manner in which a packaging element of the invention resists a compressive force.
FIG. 9 illustrates a perspective view of an extruder during extrusion of a bar-like form from which packaging material of the invention is made.
FIG. 10 illustrates a flow diagram of a method of making a packaging material of the invention.

Referring to FIG. 1, the packaging element 10 is of a block-like U-shape form with a body portion 11 and two leg portions 12 which extend integrally from the body portion 11 to define a recess R therebetween. As used herein, the term "block-like" is intended to characterize the elements 10 as having an extruded length L, i.e., a length along the axis of extrusion of the elements 10 (see FIG. 9), which is not greater than the width W of the element 10. As shown in FIG. 2, both the body portion 11 and the leg portions 12 of the packaging element 10 are of generally rectangular cross-sectional shape with slightly rounded peripheral contours. As also indicated in FIG. 2, the height $H_1$ of the body portion 11 is substantially equal to the height $H_2$ of each leg portion 12 of the packaging element. That is, the leg portions 12 each extend from the body portion 11 a distance substantially equal to the height or thickness of the body portion 11.

Referring to FIGS. 1 and 2, the body portion 11 is provided with a plurality of parallel disposed transverse grooves 13 in a surface opposite the leg portions 12. The grooves 13 are parallel to one another and normal to the longitudinal axis of the recess R defined by the leg portions 12, and the grooves 13 serve to define a plurality of interconnected body portion segments 14.

As indicated in FIGS. 1 and 2, the grooves 13 are of a depth D which is a fraction of the height or thickness $H_1$ of the body portion 11 and are of a substantially V-shaped cross-section. As shown in FIG. 1, the grooves 13 extend completely across the width of the upper surface of the body element 11, and may also extend downwardly along side walls of the body portion 11 and toward the leg portions 12.

Referring to FIG. 1, each packaging element 10 is of a U-shape with an extruded length L of about one inch and a body portion width W of about one inch. The thickness of the body portion is about 5/16 inch, the leg portions have an extruded width of about ⅜ inch and the body portion segments 14 each have a length of about ⅜ inch in the extruded direction.

The elements 10 can be made of any suitable resilient material, for example, of an extruded foamed thermoplastic material such as polystyrene, polyethylene, polypropylene or polyurethane. The elements 10 may be provided in an expandable state or in an expanded state, as is known.

Referring to FIG. 3, in use, a supply of packaging elements 10 is stored within a hopper 15 having a mouth 16 of reduced size. In order to package an item 17 (see FIG. 4) in a carton 18 having end flaps 19, the carton 18 is initially disposed beneath the hopper 15 in an open condition. The packaging material is then dispensed from the hopper 15 through the mouth 16 of the hopper to form a layer of packaging material on the bottom of the carton 18. The item 17 to be packaged is then placed on this layer within the carton 18, and packaging material is again discharged from the mouth 16 of the hopper 15 to fill the remainder of the carton 18. The carton 18 is filled to a slight overflowed state so that when the flaps 19 of the carton are folded over into a closed condition, the packaging material is placed under a slight compressive load within the carton 18. This serves to enhance the fixation of the items 17 within the carton 18.

Referring to FIG. 5, the packaging elements 10 are disposed in a random manner within the carton 18, and forces may be imposed on the various elements 10 from different directions. In some cases, forces F are perpendicularly imposed on the leg portions 12 and the body portion 11 in planes parallel to the cross-section taken across the width W of an element 10. These forces F attempt to compress the leg portions 12 against the body portion 11. In other cases, forces T are imposed on the sides of packaging (FIG. 6) elements 10 in planes perpendicular to the planes of the grooves 13. These forces T attempt to compress the body portion 11 longitudinally of the extruded length L of the elements 10 (FIG. 7).

The mentioned forces F tend to compress the element 10 and deform the leg portions 12 as indicated in dotted line in FIG. 6 and against the resistance of the resilient mass of the element 10. As indicated in FIG. 7, the mentioned forces T tend to compress the packaging element 10 to move its segments 14 together and thereafter to further compress the resilient mass of the element 10. The initial bringing together of the segments 14 allows a portion of the energy of the force T to be absorbed by the interconnected segments 14 in the manner of a series of interconnected flat springs. After a closing of the grooves 13, the energy of the force T is absorbed by compression of the mass of the element 10. Thus, for the relatively low forces T normally expected to occur in transit and storing, the elements 10 may be compressed to a degree sufficient to close the grooves while cushioning the packed item. However, should a higher force T be imposed on the elements 10, after a closing of the grooves 13 and a dissipation of some of the force, the total mass of each element 10 is presented to resiliently resist and absorb the remaining force. As a result, each packaging element has two states. In one state, the elements 10 absorb forces by the spring-like action of its interconnected segments 14. In another state in which the grooves 13 are closed, the elements 10 resist imposed forces by their resilient mass.

Referring to FIG. 8, should a force T' be imposed on a segment 14 at an angle as therein shown, the outer segment 14 receiving the force will be biased by the force T' toward the adjacent segment 14 so as to close the groove 13 therebetween before there is any appreciable compression of the element 10. This deflection of the outer segment 14 relative to the remainder of the body portion 11 thereby allows a portion of the force T' to be absorbed before compression of mass of the element 10 begins.

Referring to FIGS. 8 and 9, to make the packaging elements 10 of this invention, the process used may be generally any one of those as described in, for example U.S. Pat. Nos. 3,074,543 and 3,188,264. A mass of granular particles of a suitable thermoplastic material is placed in an extruded together with a hydrocarbon blowing or expanding agent as is known. An extrudate is then formed which is extruded through a die 20 having a U-shaped opening 21 to produce a rod-like form 22 of U-shaped cross-section. In addition, a fly knife 23 is positioned adjacent the die opening 21 so as to form a series of slits longitudinally at predetermined locations along the surface of the rod-like form 22 on a side opposite from the leg portions of the form 22. The bar-like form 22 is also cut transversely of the longitudinal axis of extrusion at intervals along its extruded length into small pieces by any suitable cutting means (not shown) to form the individual discrete elements 10.

By the heretofore known process, the packaging elements 10 may be fully expanded at the time of the extrusion and cutting, or the elements may be provided in a latent-foaming or expandable state following the extrusion. Referring to FIG. 10, the elements 10 may be formed by a process in which the extruded bar-like form 22 is slit and then cooled before the elements are severed. After severing, the elements may be further expanded by heat as is known at the place where the elements 10 are to be actually used for packaging. Alternatively, the form 22 can be heated prior to severing.

As the bar-like form 22 or severed element 10 of the form expand, the slits formed by the fly knife 23 allows the adjacent portions of the form 22 or severed element to move away from each other. This results in a groove 13 being formed by each slit upon completion of the expansion. Thus, it is to be noted that the slits which are imposed in the rod-like form 22 by the fly knife 23 serve to provide elements 10 which have a body portion 11 with segments 14 which are spaced from each other by the grooves 13. By suitable adjustment of the fly knife 23, the depth and width of the grooves 13 which are formed in the elements 10 can be sized so as to permit a greater or lesser absorption of forces which are imposed on the elements longitudinally of the axis of extrusion of the elements. The number and relative location of the grooves 13 can also be similarly predetermined by adjustment of the fly knife 23 to provide a greater or lesser number of interconnected segments 14.

The elements 10 react in the nature of flat springs since the segments 14, separated by the grooves 13, are interconnected through the remainder of the body portion 11 and the leg portion 12. Besides increasing the resilient characteristics of the element 10, the spring-like construction of the packaging elements also reduces the amount of space occupied by a given quantity of packaging elements. That is, the described packaging elements 10 permit air spaces or voidage to be formed not only by the recess R between its leg portions 12 but also by the grooves 13 in its body portion 11.

The invention thus provides a packaging material composed of packing elements which impart an improved cushioning effect due to the spring-like construction of the elements.

What is claimed is:

1. A loose fill packaging material comprising a plurality of expanded resilient thermoplastic elements, each said element having a body portion of generally rectangular cross-sectional shape and at least two leg portions extending from one side of said body portion, said body portion having a plurality of substantially V-shaped grooves at predetermined locations in a surface thereof opposite said leg portions to define a plurality of interconnected body portion segments disposed perpendicularly of said leg portions, said grooves extending completely across the width of said surface.

2. A packaging material as set forth in claim 1 wherein two of said leg portions extending from said body portion define a recess therebetween, and wherein the grooves are parallel to one another and normal to the longitudinal axis of the recess.

3. A packaging material as set forth in claim 1 wherein each said element has a block-like form.

4. A packaging material as set forth in claim 1 wherein said elements are made of expanded polystyrene.

5. A loose fill packaging material comprising a plurality of expanded resilient thermoplastic elements, each said element being of a block-like U-shaped form and having body portion of generally rectangular cross-sectional shape and two leg portions extending from said body portion and defining a recess therebetween, said body portion having a plurality of substantially V-shaped grooves at predetermined locations in a surface thereof opposite said leg portions to define a plurality of interconnected body portion segments, said grooves extending completely across the width of said surface.

6. A loose fill packing element of expanded resilient thermoplastic material, said element having a body portion of generally rectangular cross-sectional shape and at least two leg portions extending from one side of said body portion to define a recess therebetween, and said body portion having a plurality of substantially V-shaped grooves at predetermined locations in a surface thereof opposite said leg portions to define a plurality of interconnected body portion segments, said grooves extending completely across the width of said surface.

7. A loose fill packaging element as set forth in claim 6 wherein the grooves are parallel to one another and normal to the longitudinal axis of the recess.

8. A loose fill packaging element as set forth in claim 6 wherein each said segment has a length substantially equal to the width of a leg portion of said element.

9. A loose fill packaging element as set forth in claim 6 having a block-like U-shaped form.

10. A loose fill packaging material comprising a plurality of expandable resilient thermoplastic elements, each said element having a body portion of generally rectangular cross-sectional shape and at least two leg portions extending from said body portion, said body portion having a plurality of slits at predetermined locations in a surface thereof opposite said leg portions to define a plurality of interconnected body portion segments disposed perpendicularly of said leg portions, said slits extending completely across the width of said surface to form grooves in each element after expansion.

11. A loose fill packing material comprising a plurality of expandable resilient thermoplastic elements, each said element being of a block-like U-shaped form and having a body portion of generally rectangular cross-sectional shape and two leg portions extending from said body portion and defining a recess therebetween, said body portion having a plurality of parallel slits at predetermined locations in a surface thereof opposite said leg portions to define a plurality of interconnected body portion segments, said slits extending completely across the width of said surface to form grooves in each element after expansion.

12. A loose fill packing element of expandable resilient thermoplastic materials, said element having a body portion of generally rectangular cross-sectional shape and at least two leg portions extending from said body portion to define a recess therebetween, and said body portion having a plurality of slits at predetermined locations in a surface thereof opposite said leg portions to define a plurality of interconnected body portion segments, said slits extending completely across the width of said surface to form grooves in each element after expansion.

* * * * *

UNITED STATES PATENT AND TRADEMARK OFFICE

CERTIFICATE OF CORRECTION

PATENT NO. : 4,169,179

DATED : September 25, 1979

INVENTOR(S) : Harry Bussey, Jr.

It is certified that error appears in the above-identified patent and that said Letters Patent are hereby corrected as shown below:

Column 2, line 68, change ":" to --;--

Column 3,line 43, after "along" insert --the--

Column 6, line 12, before "substantially" insert --parallel--

Signed and Sealed this

*First* Day of *January 1980*

[SEAL]

*Attest:*

SIDNEY A. DIAMOND

*Attesting Officer*

*Commissioner of Patents and Trademarks*